US007941062B2

(12) United States Patent
Yonekubo

(10) Patent No.: US 7,941,062 B2
(45) Date of Patent: May 10, 2011

(54) IMAGE FORMING APPARATUS TO CONTROL AN IMAGE FORMING CONDITION

(75) Inventor: Hideaki Yonekubo, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 12/127,689

(22) Filed: May 27, 2008

(65) Prior Publication Data

US 2008/0298826 A1 Dec. 4, 2008

(30) Foreign Application Priority Data

May 31, 2007 (JP) ..... 2007-145479
Apr. 2, 2008 (JP) ..... 2008-095957

(51) Int. Cl.
*G03G 15/00* (2006.01)
*G03G 15/02* (2006.01)
*G03G 15/06* (2006.01)

(52) U.S. Cl. ..... 399/44; 399/50; 399/55

(58) Field of Classification Search ..... 399/44, 399/43, 50, 55
See application file for complete search history.

(56) References Cited

U.S. PATENT DOCUMENTS 5,170,210 A * 12/1992 Saruwatari ..... 399/44
6,125,245 A * 9/2000 Shibuya et al. ..... 399/49
6,339,441 B2 1/2002 Suzuki
6,463,226 B2 * 10/2002 Kitajima et al. ..... 399/44
7,177,561 B2 * 2/2007 Serita ..... 399/44

FOREIGN PATENT DOCUMENTS

JP 58125062 A * 7/1983
JP 07287495 A * 10/1995
JP 09185218 A * 7/1997
JP 2002-258550 A 9/2002
JP 2005-300745 A 10/2005

* cited by examiner

*Primary Examiner* — Susan S Lee
(74) *Attorney, Agent, or Firm* — Canon USA, Inc. IP Division

(57) ABSTRACT

An image forming apparatus includes a rotatable photosensitive drum, a charging apparatus to which a charging voltage is applied, an exposure apparatus forming an electrostatic image, a developing apparatus to which a development voltage is applied, a timer measuring an image formation time lapsed from start of rotation of the photosensitive drum and an image formation stop time lapsed from stop of the rotation of the photosensitive drum, and a temperature and humidity sensor detecting a temperature and a humidity of an atmosphere environment around the photosensitive drum. When the humidity is low, a charging voltage is controlled based on a measured result of the timer and detected results of the temperature and humidity sensor. When the humidity is high, the charging voltage is controlled based on the measured result of the timer and the temperature detected result of the temperature and humidity sensor without using humidity information.

7 Claims, 10 Drawing Sheets

| | | ABSOLUTE MOISTURE AMOUNT W [g/m³] | | |
|---|---|---|---|---|
| | | 0 - 0.5 | 0.6 - 2.4 | 2.5 - |
| IMAGE FORMATION STOP TIME t2 [s] | 0 - 100 | 0.4 | 0.2 | 0 |
| | 100 - 1000 | 0.8 | 0.4 | 0 |
| | 1001 - | 1 | 0.6 | 0 |

IMAGE FORMING APPARATUS TO CONTROL AN IMAGE FORMING CONDITION

BACKGROUND OF THE INVENTION

1. Field of the Invention

The present invention relates to an electrophotographic image forming apparatus, such as a copying machine, a printer, and a fax.

2. Description of the Related Art

Hitherto, a photosensitive member disposed in an electrophotographic image forming apparatus generally has a photosensitive member made up of a charge generation layer and a charge transport layer.

When a print start signal is input, the photosensitive member is driven in a certain direction to start rotation. By applying a bias to a charging apparatus with respect to the surface of the photosensitive member, the surface of the photosensitive member is charged to a certain potential (hereinafter referred to as a "charging step").

The surface potential of the photosensitive member at that time is called a dark area potential VD. Onto the surface of the photosensitive member which is charged to the VD, a laser beam or an LED beam is irradiated under on/off control in accordance with a signal from a controller (hereinafter referred to as an "exposure step").

In an area of the surface of the photosensitive member which has been exposed, a potential is changed due to the exposure step and an electrostatic latent image having a different potential from that in the surroundings is formed on the surface of the photosensitive member. In the following description, the potential in the area where the electrostatic latent image is formed with the exposure is called a bright area potential VL.

A development voltage is applied to a developing apparatus which is disposed to face the photosensitive member, whereby charged toner is supplied from the developing apparatus to the electrostatic latent image formed on the surface of the photosensitive member. As a result, the electrostatic latent image is developed as a toner image on the surface of the photosensitive member (hereinafter referred to as a "developing step"). In the following description, the development voltage applied to the developing apparatus in the developing step is denoted by Vdev.

The toner image developed on the surface of the photosensitive member is brought into contact with a transfer material with the rotation of the photosensitive member and is transferred to the transfer material (hereinafter referred to as a "transfer step") . In the transfer step, the toner image is transferred to the transfer material by feeding the transfer material to pass between the photosensitive member and a transfer member, e.g., a transfer roller that is arranged adjacent to the photosensitive member and is rotated at substantially the same speed as the photosensitive member in the same direction as the rotating direction of the photosensitive member at the position where the photosensitive member and the transfer roller are opposed to each other. More specifically, the toner image is transferred from the photosensitive member to the transfer material by applying a bias with a polarity being opposite to that of the toner to the transfer member and by feeding the transfer material to pass between the photosensitive member and the transfer member in that state.

Even when the bias applied to the charging apparatus in the charging step is held constant and the exposure conditions are held constant in the exposure step, the VL is varied in some cases with repetition of image formation. In one case, residual charges are generated in the photosensitive member with the exposure, thus varying the VL during the image formation. In another case, the temperature of the photosensitive member is raised during the rotation due to sliding frictions of the photosensitive member with respect to a charging member and a cleaning member, and heat radiated from an exposure member, a fuser, etc., thus varying the VL.

In other words, when the VL is varied due to the exposure step of the photosensitive member and the temperature rise thereof, development contrast defined by the difference between Vdev and VL is changed. The change of the development contrast leads to a change in amount of toner coated on the photosensitive member and eventually causes a variation of image density on the transfer material. In the following description, the development contrast is denoted by Vcont.

With the view of stabilizing the image density, an image forming apparatus has been proposed so far in which the VL of a photosensitive member is detected by a sensor in advance and image formation conditions, e.g., an amount of supplied toner, are controlled depending on the detection result (see U.S. Pat. No. 6,339,441).

Because of the necessity of additionally installing the sensor to detect the VL of the photosensitive member, however, the proposed apparatus has the problem of increasing the cost and the size of a main unit.

Also, an image forming apparatus is proposed in which the number of rotations of the photosensitive member, which are performed prior to the exposure step for charge-cancelling and charging on the surface of the photosensitive member, is selected based on the temperature and the humidity around the photosensitive member, thereby suppressing a variation of image density when the same image is formed in large number (see Japanese Patent Laid-Open No. 2005-300745).

However, when the number of rotations of the photosensitive member is increased based on the temperature and the humidity around the photosensitive member, an overall printing speed is reduced and productivity of the image forming apparatus is deteriorated.

In view of the above-mentioned problem, an image forming apparatus is proposed in which the VL of a photosensitive member is estimated from the temperature around the photosensitive member, an image formation time, and an image formation stop time, and in which image formation conditions are controlled depending on the estimated result (see Japanese Patent Laid-Open No. 2002-258550).

However, it is confirmed that the VL is varied depending on not only the temperature of the photosensitive member, but also the absolute humidity of an atmosphere environment around the photosensitive member and the image formation time (time during which the main unit is driven). Further, it is confirmed that the variation of VL appears as not only an increase of its absolute value, but also a decrease thereof.

Nevertheless, the known technique disclosed in Japanese Patent Laid-Open No. 2002-258550 does not take into consideration the absolute humidity of the atmosphere environment around the photosensitive member and the image formation time, and it also does not suppose a possibility that the variation of VL occurs as both of an increase of VL and a decrease of VL. For that reason, the known technique cannot estimate the variation of VL with high accuracy.

Thus, the above-described known image forming apparatus cannot obtain an image in stable density by estimating the variation of VL with high accuracy. Herein, a phenomenon that the absolute value of VL is increased with the image formation time in spite of setting conditions in the charging step and the exposure step constant is called a VL-up. Also, a phenomenon that the absolute value of VL is decreased with the image formation time is called a VL-down.

A process of generation of the VL-up and the VL-down with the image formation time will be described below with reference to FIGS. 2 and 3A-3F. FIG. 2 is a conceptual view representing the surface potential of the photosensitive member, and FIGS. 3A-3F are each a chart representing the VL variation with the lapse of the image formation time or the image formation stop time (FIG. 3D).

As shown in FIG. 2, the difference between Vdev and VL, i.e., (Vdev−VL), provides Vcont. The larger Vcont, the larger is the amount of toner developed on the photosensitive member and the higher is image density.

The VL-up means a phenomenon that the VL is varied in the direction of an arrow A in FIG. 2 (i.e., the direction in which the absolute value is increased), whereby the Vcont is decreased and the image density is reduced. On the other hand, the VL-down means a phenomenon that the VL is varied in the direction of an arrow B in FIG. 2 (i.e., the direction in which the absolute value is reduced), whereby the Vcont is enlarged and the image density is increased.

A description is first made of the phenomenon of the VL-up. In an L/L environment (low-temperature and low-humidity environment), e.g., an environment of 15° C. and 10% RH, the phenomenon of the VL-up occurs with the lapse of the image formation time, as shown in FIG. 3A, even when the image formation is continuously performed just on several sheets.

Further, it is confirmed that, in an environment where the atmosphere around the photosensitive member has lower absolute humidity, an increase rate of VL per unit time becomes larger. In other words, the lower the absolute humidity of the atmosphere around the photosensitive member, the more significantly appears the phenomenon of the VL-up.

In addition, the VL-up is affected by the time during which the photosensitive member has been held stopped before the start of the image formation (i.e., the image formation stop time) such that the increase amount of VL becomes larger at a longer image formation stop time.

For example, when the image formation stop time is long, the VL is increased up to V1 as shown in FIG. 3A. However, when the image formation stop time is short, the VL is increased just to V2 lower than V1 as shown in FIG. 3B.

Such a phenomenon of the VL-up is primarily attributable to the fact that the number of residual charges in the photosensitive layer is increased due to the exposure on the photosensitive member during the image formation. Stated another way, in an environment where the absolute humidity of the atmosphere environment around the photosensitive member is low, the resistance of any layer in the photosensitive layer is so increased that movement and injection of charges within the photosensitive layer are hard to smoothly occur, and the number of residual charges in the photosensitive layer is increased. Hence the VL-up is resulted.

The residual charges generated with the image formation are gradually drained to the ground through the photosensitive layer when the image formation is ended and stopped. As the image formation stop time is prolonged, the number of residual charges generated during the preceding image formation is reduced, thus resulting in a state where the residual charges are more apt to accumulate in the next image formation. Accordingly, as the image formation stop time is prolonged, the influence of the VL-up appears more significantly and the increase amount of VL becomes larger when the next image formation is performed.

A description is next made of the phenomenon of the VL-down. In an environment other than low-temperature and low-humidity, e.g., an environment of 23° C. and 50% RH, the phenomenon of the VL-down occurs with the lapse of the image formation time, as shown in FIG. 3C, when the image formation is continuously performed.

On the other hand, the VL having been reduced with the VL-down shows a greater tendency to restore to the original VL as the time during which the image formation is not performed after the image formation (i.e., the image formation stop time) is prolonged.

For example, when the VL in the preceding image formation is reduced to V4 due to the VL-down with the preceding image formation as shown in FIG. 3C, the initial VL in the next image formation shows a value closer to the original VL, i.e., V3, at a longer image formation stop time, as shown in FIG. 3D.

Such a phenomenon of the VL-down is primarily attributable to the fact that the number of residual charges in the photosensitive layer is reduced. Stated another way, the cause of the VL-down resides in that, because the image formation raises the temperature of the photosensitive member and reduces the resistance of the photosensitive layer, the residual charges trapped in the photosensitive layer is moved externally of the photosensitive member.

The temperature rise of the photosensitive member with the lapse of the image formation time is primarily caused by sliding frictions of the photosensitive member with contact members, such as the developing member, the charging member and the cleaning member, and heat radiated from the exposure member, the fuser, etc.

Further, based the above-described experiment results, it is confirmed that the temperature of the photosensitive member can be accurately estimated from the temperature of the atmosphere environment around the photosensitive member, which also causes the temperature rise of the photosensitive member, the image formation time, and the image formation stop time.

Additionally, the above-described phenomena of the VL-up and the VL-down appear either one or both of them depending on the temperature of the atmosphere environment around the photosensitive member and the absolute humidity of the atmosphere environment.

For example, in an environment where the absolute humidity is low, the increase amount of VL due to the VL-up is very large so that the influence of the VL-down does not appear and only the influence of the VL-up significantly appears in many cases. On the other hand, in an environment where the absolute humidity is high, because the VL-up is hard to occur, the influence of the VL-down significantly appears in many cases.

Further, in some environment, the VL-up and the VL-down often occur simultaneously to cause such a phenomenon that, as shown in FIG. 3E, the VL is initially increased and is gradually reduced thereafter.

In another environment, as shown in FIG. 3F, there may cause a phenomenon that the VL is initially reduced and is gradually increased thereafter.

Thus, the following findings are confirmed. The VL-up can be estimated based on the absolute humidity, the temperature, the photosensitive member stop time, the photosensitive member rotation time. Also, the VL-down can be estimated based on the temperature, the photosensitive member stop time, and the photosensitive member rotation time without employing the absolute humidity. Those estimations of the VL-up and the VL-down are described later.

As still another finding, it is confirmed that when the absolute humidity has a high value, the VL-up is not generated and the VL can be accurately estimated by taking into account only the VL-down.

SUMMARY OF THE INVENTION

An embodiment of the present invention provides an image forming apparatus which can produce an image with stable density by executing proper control to change image formation conditions between when the absolute humidity is low and when the absolute humidity is high.

According to the present invention, an image forming apparatus includes a rotatable photosensitive member, a charging apparatus configured to charge a surface of the photosensitive member when applied with a charging voltage, an exposure apparatus configured to expose the surface of the photosensitive member after being charged so as to form an electrostatic image, a developing apparatus configured to attach a developer to the electrostatic image and to develop the electrostatic image as a developer image when applied with a development voltage, a time measuring apparatus configured to measure information regarding a photosensitive member rotation time that represents a time during which the photosensitive member is rotated, and information regarding a photosensitive member stop time that represents a time during which the photosensitive member is stopped, an environment measuring apparatus configured to measure information regarding temperature and information regarding absolute humidity, and a control apparatus configured to control an image formation condition based on the information regarding the temperature and the information regarding the absolute humidity which are measured by the environment measuring apparatus, and the information regarding the photosensitive member rotation time and the information regarding the photosensitive member stop time which are measured by the time measuring apparatus when the absolute humidity is within a first range, and to control the image formation condition based on the information regarding the temperature measured by the environment measuring apparatus, and the information regarding the photosensitive member rotation time and the information regarding the photosensitive member stop time which are measured by the time measuring apparatus, without using the information regarding the absolute humidity measured by the environment measuring apparatus, when the absolute humidity is within a second range, wherein the second range corresponds to a higher humidity range than the first range.

Further features of the present invention will become apparent from the following description of exemplary embodiments with reference to the attached drawings.

DESCRIPTION OF THE EMBODIMENTS

An exemplary embodiment of the present invention will be described below in detail with reference to the drawings. It is to be noted that dimensions, materials, shapes, relative positional arrangements, etc. of components, which are described in the exemplary embodiment, should not be construed to limit the scope of the invention unless otherwise specified.

(Overall Construction of Image Forming Apparatus)

Figure 4:
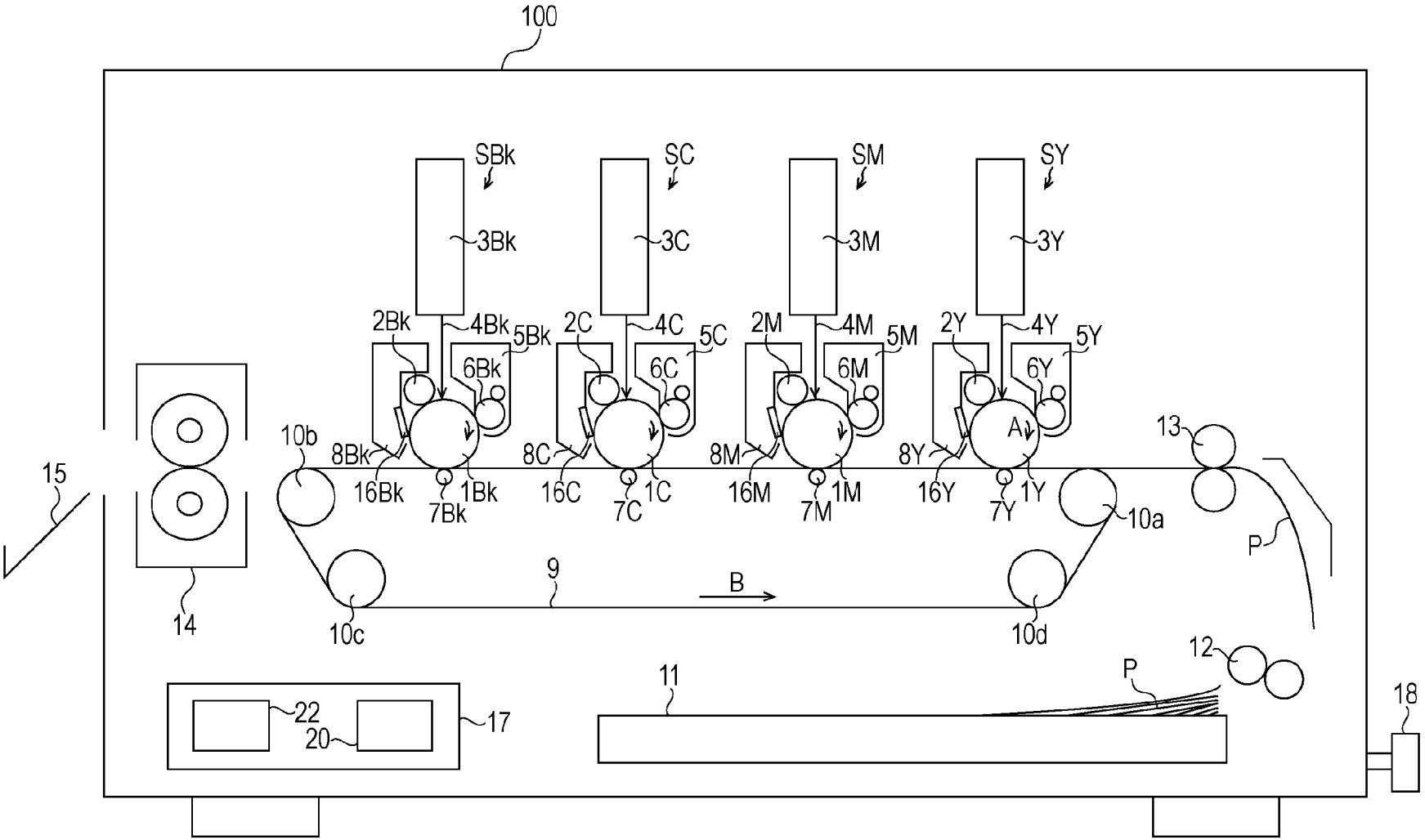
FIG. 4 is a schematic view of an image forming apparatus according to the exemplary embodiment.

FIG. 4 is a schematic view of an image forming apparatus according to the exemplary embodiment. An image forming apparatus 100 is assumed herein to be a laser beam printer for forming an image on a recording medium (transfer material), e.g., a sheet of recording paper, an OHP sheet, or a piece of cloth, with an electrophotographic image forming process.

The image forming apparatus 100 according to this exemplary embodiment includes a cylindrical photosensitive drum (photosensitive member) 1 that is disposed as an image bearing member in a rotatable manner. The photosensitive drum 1 is disposed four in a one-to-one relation to types of toner (developer) . Each photosensitive drum 1 is rotated about a rotary shaft (not shown) in the direction of an arrow A in FIG. 4.

When a signal for starting the image formation is input, the photosensitive drum 1 starts rotation and the surface of the photosensitive drum 1 is uniformly negatively charged by a charging roller (charging apparatus) 2.

After the surface of the photosensitive drum 1 has been negatively charged, an exposure apparatus 3 emits a laser beam 4 in accordance with image information to expose the surface of the photosensitive drum 1 in a scanning way, thereby forming an electrostatic latent image on the drum surface. Note that, as in the above description, the surface potential of the photosensitive drum 1 in the charging step is denoted by VD, and the surface potential in an area of the photosensitive drum which has been subjected to the exposure is denoted by VL.

A developing apparatus 5 develops the electrostatic latent image as a toner image (developer image) by attaching the toner to the electrostatic latent image formed on the photosensitive drum 1. A development voltage applied to the developing apparatus 5 in a development step is denoted by Vdev and development contrast, i.e., the difference between Vdev and VL, is denoted by Vcont.

The toner image formed on the photosensitive drum 1 is transferred to a transfer material P, which is carried on a transfer belt 9, in a position between the photosensitive drum 1 and a transfer roller 7 which is disposed as a transfer member. At that time, the toner image is transferred from the photosensitive drum 1 to the transfer material P by applying a transfer bias to the transfer roller 7. The transfer material P is stacked plural in a paper supply tray 11 which is arranged under a main unit of the apparatus, and it is conveyed to the transfer belt 9 through a feed roller 12 and a conveying roller 13.

On the other hand, the toner remaining on the surface of the photosensitive drum 1 without being transferred to the transfer material P is removed by a cleaning blade 16 which is disposed in contact with the surface of the photosensitive drum 1, and is then recovered to a waste toner container 8.

The transfer belt 9 is stretched over four rollers 10*a*, 10*b*, 10*c* and 10*d*, and it is rotated in the direction of an arrow B in FIG. 4 to successively convey the transfer material P, which is carried on the transfer belt 9, to image forming stations SY, SM, SC and SBk for respective colors. By transferring the toner image to the transfer material P from the photosensitive drum 1 in each of the stations SY, SM, SC and SBk for respective colors, the toner images of the respective colors are superimposed on the transfer material P with one another, whereby a desired image is formed.

After the image transfer to the transfer material P, the transfer material P is conveyed to a fixing apparatus 14 in which the toner images transferred to the surface of the transfer material P are fused and fixed onto the transfer material P. The transfer material P having passed the fusing step is ejected into a tray 15 that is arranged outside the color image forming apparatus 100.

In addition to the above-described construction, the image forming apparatus 100 includes a temperature and humidity sensor 18 as an environment measuring apparatus. The temperature and humidity sensor 18 detects the temperature and the humidity of an atmosphere environment around the photosensitive drum 1. While one unit of the temperature and humidity sensor is used as the environment measuring apparatus in this exemplary embodiment, the temperature and the humidity can also be detected by respective sensors separately disposed.

The detected temperature and humidity are output to a CPU 22. The CPU 22 calculates, based on the input detected results of the temperature and the humidity, the absolute humidity of the atmosphere environment and stores information of the calculated temperature and absolute humidity of the atmosphere environment in a storage unit 20 in units of 0.1° C. and 0.1 g/m$^3$, respectively. The storage unit 20 and the CPU 22 are both disposed in an engine control unit 17 which is disposed under the main unit. In the context of the present specification, the term "absolute humidity" is used to referred to an amount (g) of water vapor (i.e., a moisture amount) contained in a unit volume of the atmosphere environment. The absolute humidity may be represented in unit of g/m$^3$. In this exemplary embodiment, the absolute humidity is calculated in the CPU 22 based on the detected results of the temperature and humidity sensor 18.

A place where the temperature and humidity sensor 18 disposed is not limited to the illustrated position. For example, the temperature and humidity sensor 18 can also be disposed around the photosensitive drum 1 or in some other desired position.

Also, while this exemplary embodiment is described above as storing the temperature and the absolute humidity of the atmosphere environment in the storage unit 20 in units of 0.1° C. and 0.1 g/m$^3$, respectively, the units are not limited to particular ones and other suitable units can also be used.

Further, while this exemplary embodiment employs a one-component development method, the development method is not limited thereto and a two-component development method is also usable.

The toner used in this exemplary embodiment can be provided by the known toner used in the electrophotographic method, and optimum toner is selected in conformity with the developing step. Additionally, while a non-magnetic developer is used as the developer in this exemplary embodiment, a magnetic developer can also be used.

(Construction of Photosensitive Drum)

The construction of the photosensitive drum 1 used in this exemplary embodiment will be described next with reference to FIG. 5. A photosensitive layer of the photosensitive drum 1 in this exemplary embodiment is of the stacked type that the photosensitive layer is functionally separated into a charge generation layer containing a charge generation substance and a charge transport layer containing a charge transport substance. A surface protective layer is formed at the top of the stacked photosensitive layer. The layers forming the photosensitive drum 1 will be described below one by one.

(Substrate Layer 1*a*)

A support member for the photosensitive layer is formed of a conductive member. For example, the support member is obtained by forming a metal, e.g., aluminum, an aluminum alloy, copper, zinc, stainless steel, vanadium, molybdenum, chromium, titanium, nickel, or indium, into a drum- or sheet-like shape.

Another example of the support member can be obtained by laminating a metal foil of, e.g., aluminum or copper on a plastic film, or by vacuum-depositing, e.g., aluminum, indium oxide or tint oxide on a plastic film.

Still another example is a sheet or film of, e.g., metal, plastic or paper on which a conductive layer is formed by coating a conductive substance alone or together with a binding resin.

Figure 5:
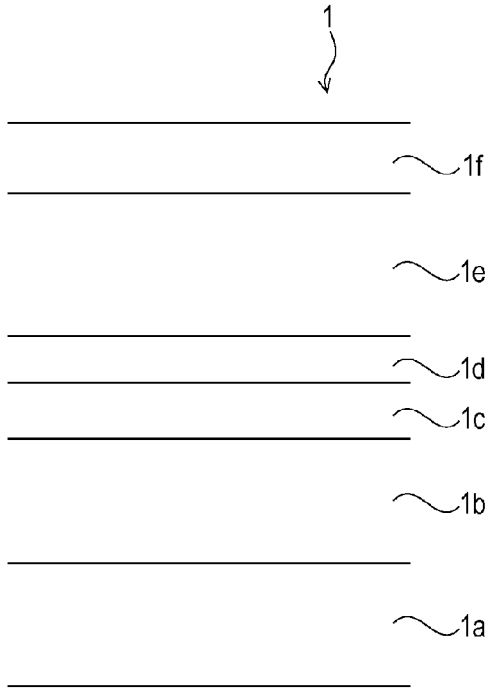
FIG. 5 is a schematic view of the photosensitive drum in the exemplary embodiment.

In this exemplary embodiment, as shown in FIG. 5, an Al substrate 1*a* is employed as a substrate layer.

(Undercoating Layer 1*b*)

As shown in FIG. 5, an undercoating layer 1*b* having a barrier function and a bonding function is formed on the Al substrate 1*a*.

Materials used in this exemplary embodiment for the undercoating layer 1*b* can be selected from among, e.g., polyvinyl alcohol, polyethylene oxide, nitrocellulose, ethylcellulose, methylcellulose, and ethylene-acrylate copolymer. Other examples of the materials include alcohol-dissoluble amide, polyamide, polyurethane, casein, glue, and gelatin.

The undercoating layer 1*b* is formed by coating a solution, which is prepared by dissolving one of the above-mentioned materials in an appropriate solvent, on the Al substrate 1*a* and drying the coating.

(Positive Charge Anti-Injection Layer 1*c*)

A positive charge anti-injection layer 1*c* of medium resistance is formed on the undercoating layer 1*b* to prevent positive charges, which are injected from the Al substrate 1*a*, from cancelling negative charges charged on the surface of the photosensitive drum 1.

(Charge Generation Layer 1*d*)

A charge generation layer 1*d* containing a charge generation substance is formed on the positive charge anti-injection layer 1*c*.

The charge generation material used in the charge generation layer 1*d* can be selected from among azo pigments such as mono-azo, dis-azo and tris-azo, phthalocyanine pigments such as metallic phthalocyanine and non-metallic phthalocyanine, and indigo pigments such as indigo and thioindigo.

Other examples of the charge generation material include perylene pigments such as perylenic anhydride and perylenic imide, polycyclic quinone pigments such as anthraquinone and pyrenequinone, squalelium colorants, pyrylium salt and thiapyrylium salt, and triphenylmethane colorants.

Still other examples of the charge generation material include inorganic substances such as selenium, selenium-tellurium and amorphous silicon, quinacridone pigments, azlenium salt pigments, cyanine dyes, xanthene colorants, quinoneimine colorants, styryl colorants, cadmium carbide, and zinc oxide.

Among those examples, in particular, metal phthalocyanines, such as oxytitanium phthalocyanine, hydroxylgallium phthalocyanine, and chlorogallium phthalocyanine, are advantageously used.

The charge generation layer 1*d* can be formed by applying a coating solution for the charge generation layer, which is prepared by dispersing the charge generation material together with a binding resin and a solvent, and drying the applied coating.

The charge generation substance can be dispersed by one of methods using, e.g., a homogenizer, an ultrasonic wave, a ball mill, a sand mill, an attriter, and a roll mill. A ratio of the charge generation substance and the binding resin is advantageously in the range of 10:1 to 1:10 (mass ratio) and more advantageously in the range of 3:1 to 1:1 (mass ratio).

The solvent used to prepare the coating solution for the charge generation layer is selected in consideration of solubility and dispersion stability of the binding resin and the charge generation substance which are used in practice. Examples of selectable organic solvents include alcohols, sulfoxides, ketones, ethers, esters, aliphatic halogenated hydrocarbons, and aromatic compounds.

The coating solution for the charge generation layer can be applied by one of coating methods, such as spray coating, spinner coating, roller coating, Meyer bar coating, and blade coating.

(Charge Transport Layer 1*e*)

A charge transport layer 1*e* containing a charge transport substance is formed on the charge generation layer 1*d*. The charge transport layer 1*e* is formed of an appropriate charge transport substance that can be selected from among, e.g., tryarylamine compounds, hydrazone compounds, styryl compounds, stilbene compounds, pyrazoline compounds, oxazole compounds, thiazole compounds, and triallylemethane compounds.

A binding resin for use in the charge transport layer 1*e* can be selected from among, e.g., an acrylic resin, styrene resin, a polyester resin, a polycarbonate resin, a polyarylate resin, and a polysulfone resin. Other examples of the binding resin include a polyphenylene oxide resin, an epoxy resin, a polyurethane resin, an alkyd resin, and an unsaturated resin.

In particular, however, a polymethylmethacrylate resin, a polystyrene resin, a styrene-acrylonitrile copolymer resin, a polycarbonate resin, a polyarylate resin, a diarylphthalate resin, etc. are advantageously used. One or more of those resins can be used alone, in a mixed form, or as a copolymer.

The charge transport layer 1*e* can be formed by applying a coating solution for the charge transport layer, which is prepared by dispersing the charge transport material and the binding resin in a solvent, and drying the applied coating. A ratio of the charge transport substance and the binding resin is advantageously in the range of 2:1 to 1:2 (mass ratio).

The solvent used to prepare the coating solution for the charge transport layer is selected from among ketones such as acetone and methylethylketone, and esters such as methyl acetate and ethyl acetate. Other example of the solvent include ethers such as dimethoxymethane and dimethoxyethane, aromatic hydrocarbons such as toluene and xylene, and hydrocarbons having replaced halogen atoms, such as chlorobenzene, chloroform, and carbon tetrachlorides.

The coating solution for the charge transport layer can be applied by one of coating methods, such as dipping (dip coating), spray coating, spinner coating, roller coating, Meyer bar coating, and blade coating.

(Surface Protective Layer 1*f*)

A surface protective layer 1*f* is formed as a surface layer on the charge transport layer 1*e*. The surface protective layer 1*f* is formed by applying a coating solution, which is prepared by dissolving or diluting a curing phenol resin in a solvent, etc., on the photosensitive layer, thus causing a polymerization reaction after the coating to form a cured layer.

(Control System Configuration for Image Formation Condition Control)

Figure 1:
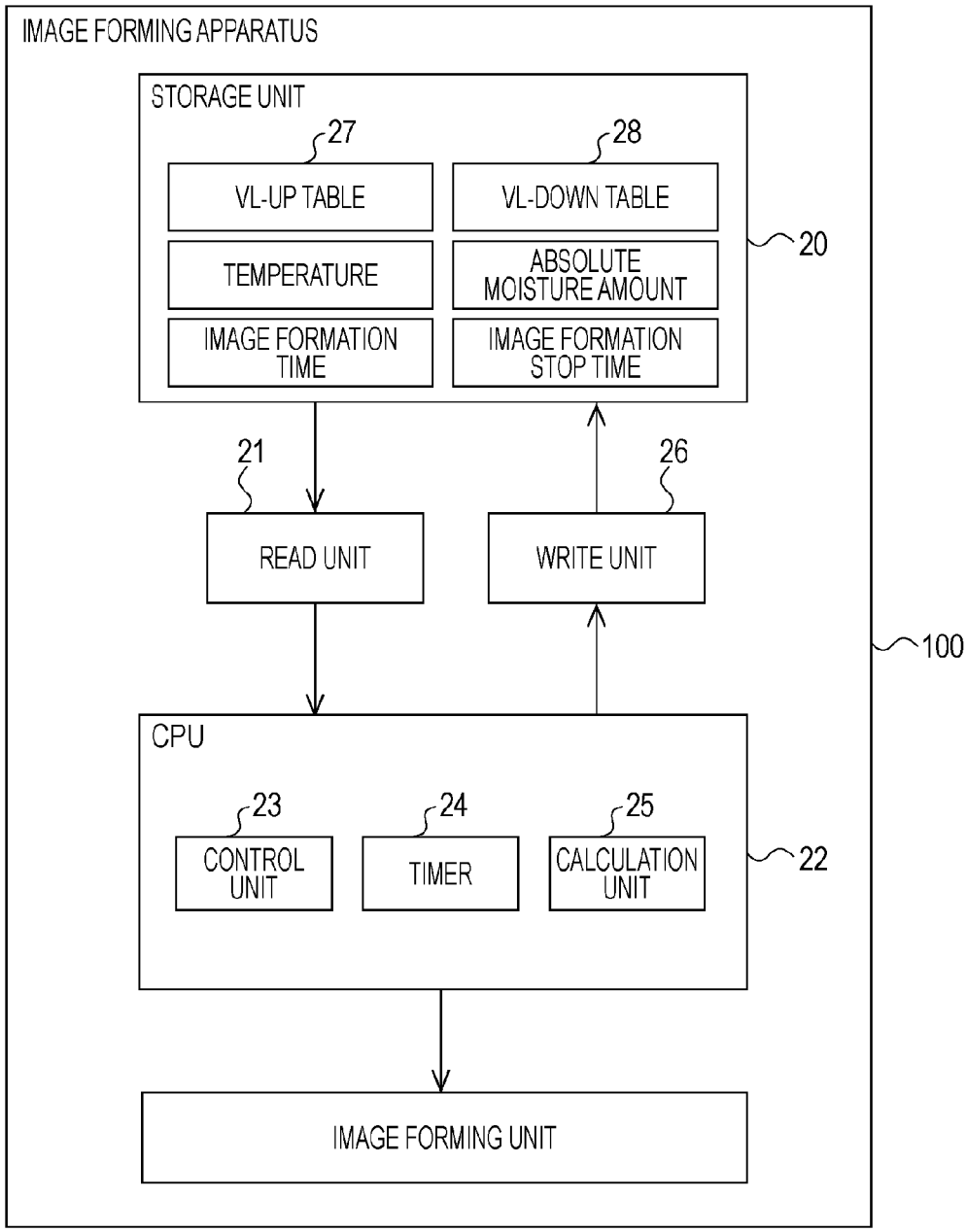
FIG. 1 is a block diagram of a control system configuration to execute image formation condition control in an exemplary embodiment of the present invention.

A control system configuration to execute image formation condition control in the image forming apparatus 100 according to this exemplary embodiment will be described with reference to FIG. 1. FIG. 1 is a block diagram of the control system configuration to execute the image formation condition control in this exemplary embodiment.

The image formation condition control is partly executed as control for holding constant a maximum density per color (hereinafter referred to as "Dmax control") and as control for holding a gradation characteristic of half-tone linear with respect to an image signal (hereinafter referred to as "Dhalf control").

Considering that the maximum density per color is affected by the film thickness of the photosensitive drum 1 and the atmosphere environment, the Dmax control is executed to set image formation conditions, e.g., the charging voltage and the development voltage, based on the result of environment detection and CRG tag information so as to obtain a desired maximum density.

On the other hand, aiming to avoid a possibility that a natural image cannot be formed due to a deviation of output density with respect to an input image signal, which is caused by a nonlinear input/output characteristic (γ characteristic) specific to the electrophotography, the Dhalf control is executed to perform image processing in such a manner as canceling the γ characteristic and holding linear the input/output characteristic.

More specifically, the relationship between the input image signal and density is obtained by detecting a plurality of toner patches corresponding to different input image signals with an optical sensor. Based on the obtained relationship, the image signal input to the image forming apparatus is converted so that the desired density is provided in accordance with the input image signal. The Dhalf control is executed after the image formation conditions, e.g., the charging voltage and the development voltage, have been determined with the Dmax control.

When a variation of VL is caused and the density of an output image is changed with the lapse of an image formation time, a color variation can be suppressed by executing the Dmax control and the Dhalf control frequently, e.g., per five printed sheets.

However, executing the Dmax control and the Dhalf control frequently greatly reduces the printing speed and significantly deteriorates productivity of the image forming apparatus. In other words, such control is not realistic from the viewpoint of practice.

In this exemplary embodiment, therefore, the Dmax control and the Dhalf control are executed just once per 1000 printed sheets. Note that while the timing of executing the Dmax control and the Dhalf control is set once per 1000 printed sheets in this exemplary embodiment, the control timing is not limited to particular one.

Stated another way, both the types of control can be executed at different timing, or the Dhalf control can be dispensed with. Further, the timing of executing the Dmax control and the Dhalf control can also be determined on the basis of a toner consumption, for example, instead of the number of printed sheets.

In this exemplary embodiment, however, because the Dmax control and the Dhalf control are executed just once per 1000 printed sheets, the VL is greatly varied during a period corresponding to the 1000 printed sheets. Accordingly, if the image formation condition control is executed with only the Dmax control and the Dhalf control, a stable image density cannot be obtained.

For that reason, in this exemplary embodiment, image formation condition control for correcting the variation of VL so as to hold constant the development contrast (Vcont) is executed as additional image formation condition control other than the Dmax control and the Dhalf control.

More specifically, the development contrast (Vcont) is held constant by controlling at least one of the charging voltage and the development voltage Vdev, which have been determined by the Dmax control, based on an estimated variation of VL.

Such image formation condition control is executed with the control system configuration illustrated in FIG. 1. As illustrated in FIG. 1, an image formation condition control system in this exemplary embodiment includes a storage unit 20, a read unit 21, a write unit 26, and a CPU 22.

The storage unit 20, the read unit 21, the write unit 26, and the CPU 22 are all incorporated in the engine control unit 17 of the image forming apparatus 100 illustrated in FIG. 4. While a known electronic memory can be used as the storage unit 20, the storage unit 20 is not limited the electronic memory. In this exemplary embodiment, a nonvolatile EEPROM is used as the storage unit 20.

Further, the CPU 22 includes a calculation unit 25 for correcting the variation of VL, a control unit 23 for controlling the image formation condition control in accordance with a VL correction amount which is calculated by the calculation unit 25, and a timer 24, i.e., a time measuring apparatus capable of measuring the image formation time and the image formation stop time.

The timer 24 counts the image formation time in units of one second during a period in which the photosensitive drum 1 is driven. Further, the timer 24 counts the image formation stop time in units of one second during a period in which the photosensitive drum 1 is stopped.

While the timer 24 counts time in units of one second in this exemplary embodiment, the unit for the time count is not limited to particular one and it can also be set to other unit than one second. The image formation time and the image formation stop time measured by the timer 24 are stored in the storage unit 20 through the write unit 26.

While the image formation time and image formation stop time are both counted by the timer 24 in this exemplary embodiment, the image formation time and image formation stop time can also be measured by two sensors independently of each other.

In addition, the control system configuration to execute the image formation condition control in this exemplary embodiment includes the read unit 21 for reading the information stored in the storage unit 20. The read unit 21 sends, to the CPU 22, the information that has been read from the storage unit 20.

Based on the information stored in the storage unit 20, the calculation unit 25 in the CPU 22 calculates a VL-variation correction amount by a later-described method. In accordance with the VL-variation correction amount which has been calculated in the calculation unit 25, the control unit 23 sends, to an image forming unit, the information for controlling the image formation conditions.

(Control Method with Image Formation Condition Control)

The following description is made of a method for calculating a VL-up correction amount, a method for calculating a VL-down correction amount, and a control method with the image formation condition control, which are executed based on the above-described control system configuration of the image formation condition control.

In order to stabilize the image density when the VL variation, i.e., the VL-up and the VL-down, is caused, the control system is required to determine the correction amount for correcting the VL variation and to execute the image formation condition control in accordance with the determined correction amount.

The image formation condition control can be executed as control of the developing voltage Vdev and/or control of the charging voltage. Particularly, a control method of controlling the charging voltage of the charging apparatus 2 (i.e., the image formation condition) is described in this exemplary embodiment.

More specifically, the image formation condition control is executed by determining the VL variation due to the VL-down and the VL-up, and by adding, to the charging voltage as a reference, the correction amount (VL-down correction amount and VL-up correction amount) that cancels the VL variation. In this exemplary embodiment, the charging voltage as a reference is the charging voltage that is determined by the Dmax control.

Further, in this exemplary embodiment, since it is confirmed that characteristics of the photosensitive drum 1 have no differences among the stations of Y, M, C and K, the following method of controlling the charging voltage is applied to all the stations.

Figure 6:
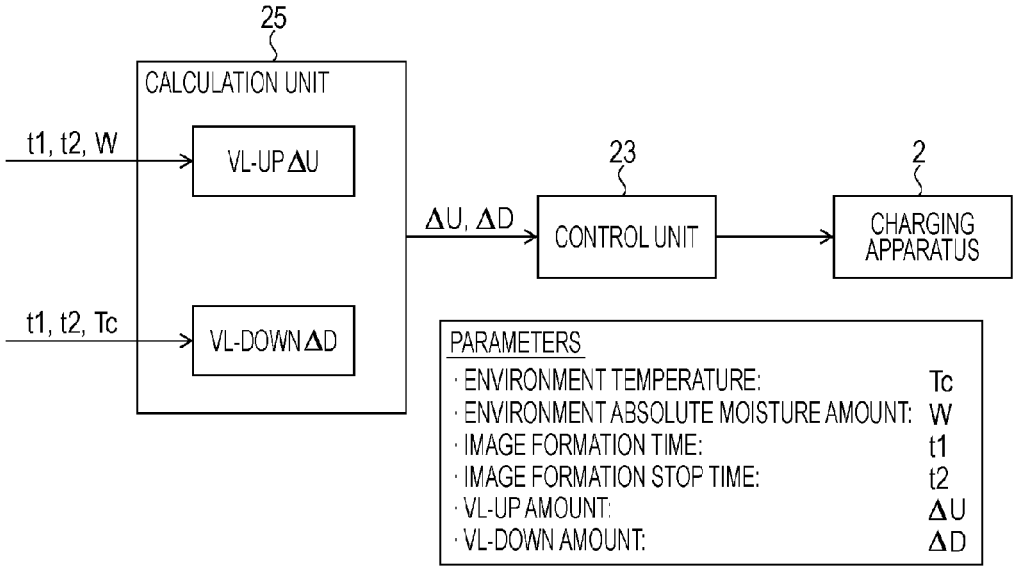
FIG. 6 is a block diagram illustrating the concept of the image formation condition control in the exemplary embodiment.

FIG. 6 is a block diagram illustrating the concept of the image formation condition control in this exemplary embodiment. More specifically, FIG. 6 illustrates a process in which the control unit 23 executes the control of the charging voltage in the charging apparatus 2 in accordance with the VL variation calculated in the calculation unit 25.

In this exemplary embodiment, the term "image formation time" (denoted by t1 hereinafter) means a time lapsed after the photosensitive drum 1 in the stop state has started driving. Also, the term "image formation stop time" (denoted by t2 hereinafter) means a time lapsed after the photosensitive drum 1 has stopped the driving. In this exemplary embodiment, though described later, information is reset by setting t1=0 when one sequence of image formation (one unit of image formation job) is started. Accordingly, the image formation time t1 corresponds to a photosensitive drum rotation time from the start of the image formation to execution of the image formation condition control by the control unit. Also, information is reset by setting t2=0 when one sequence of image formation (one unit of image formation job) is ended. Accordingly, the image formation stop time t2 corresponds to a photosensitive drum rotation stop time from the end of the preceding image formation to the start of the next image formation. Alternatively, the calculation method can be modified such that the image formation time t1 and the image formation stop time t2 are stored as respective values accumulated from power-on of the image forming apparatus, and the VL variation is determined by using the accumulated values.

Further, it is assumed that W represents the absolute humidity of the atmosphere environment, Tc the temperature of the atmosphere environment, ΔU the variation amount due to the VL-up, and ΔD the variation amount due to the VL-down. The absolute humidity W of the atmosphere environment and the temperature Tc of the atmosphere environment are defined respectively as the absolute humidity and the temperature of the atmosphere environment when the Dmax control is executed. In the image forming apparatus of this exemplary embodiment, after power-on, the apparatus comes into a standby state by performing a preliminary multi-rotation operation in which the photosensitive drum 1 is rotated to be ready for the image formation. During a period from the power-on of the image forming apparatus until coming into the standby state, the Dmax control and the measurement of absolute humidity and temperature are performed, and the measured results are stored in the storage unit. Also, the photosensitive drum 1 used in this exemplary embodiment is of the negative charging type. For example, when the reference VL is −100 V, the VL becomes −120 V with generation of the VL-up and becomes −80 V with generation of the VL-down. Thus, ΔU takes 0 or a negative value, and ΔD takes 0 or a positive value.

The calculation unit 25 calculates a first correction amount and a second correction amount from the VL variation, and the control unit 23 controls, in accordance with those estimated results, the charging voltage applied to the charging apparatus 2 so that Vcont is held constant.

To determine the VL variation, it is first required to determine both the variation due to the VL-up and the variation due to the VL-down.

The calculation unit 25 determines the VL variation by calculating the variation due to the VL-up and the variation due to the VL-down. More specifically, the calculation unit 25 calculates the variation amount ΔU due to the VL-up by using three parameters t1, t2 and W, and the variation amount ΔD due to the VL-down by using three parameters t1, t2 and Tc.

Further, characteristics regarding the VL variation are given in a table that is stored in the storage unit 20, and the calculation unit 25 calculates the VL variation by referring to the table. The following description is made of a method of calculating the correction amounts (first correction amount and second correction amount) for VL variation due to the VL-down and the VL-up.

(Method of Calculating Correction Amount (First Correction Amount) for VL Variation due to VL-down)

First, a description is made of the method of calculating the correction amount (first correction amount) for the VL variation due to the VL-down. The variation amount ΔD due to the VL-down is calculated by referring to a VL-down table 28, shown in FIG. 1, which is stored in the storage unit 20.

Figure 8A:
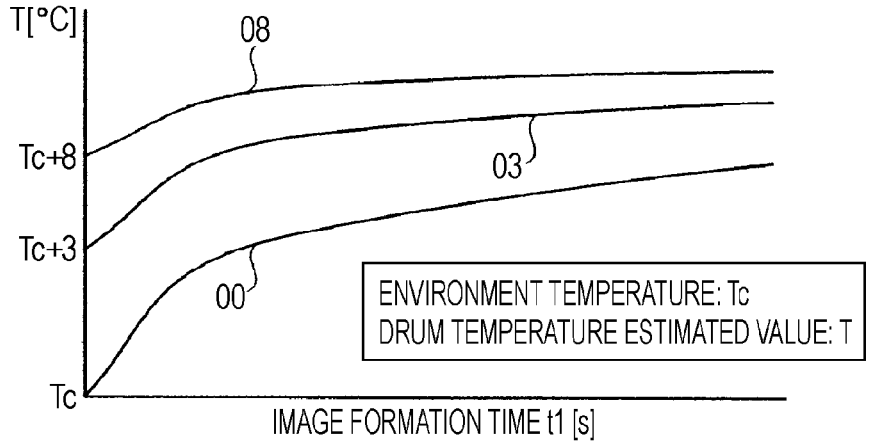
FIGS. 8A, 8B and 8C illustrate details of a VL-down table in the exemplary embodiment.
Figure 8B:
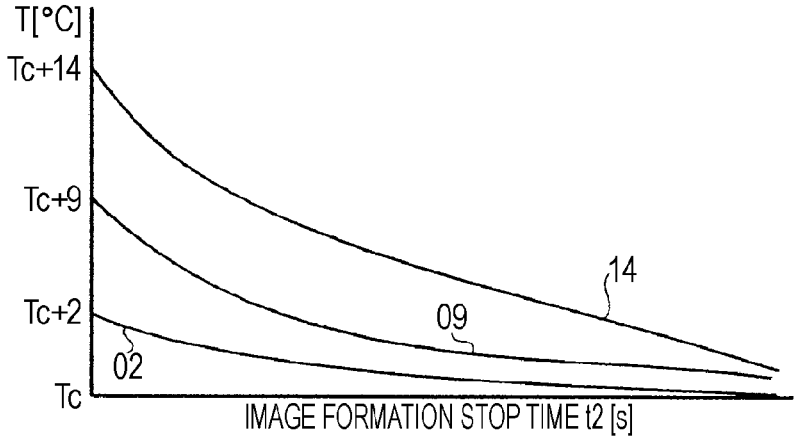
Figure 8C:
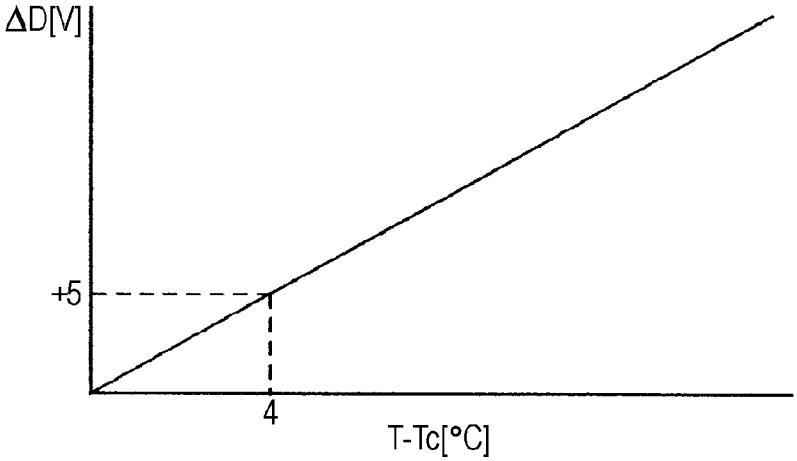

As shown in FIGS. 8A-8C, the VL-down table 28 is made up of a table C, a table D, and a table E. The variation amount ΔD due to the VL-down with respect to the image formation time is calculated based on those tables.

In this exemplary embodiment, since there is correlation between the variation amount ΔD due to the VL-down and the temperature of the photosensitive drum 1 as described above, the variation amount ΔD due to the VL-down is calculated by estimating the temperature of the photosensitive drum 1.

More specifically, the temperature of the photosensitive drum 1 during the image formation is calculated by referring to the table C, and the temperature of the photosensitive drum 1 during the stop of the image formation is calculated by referring to the table D.

Further, the variation amount due to the VL-down is calculated by referring to both the calculated temperature of the photosensitive drum 1 and the table E.

The VL-down table 28 will be described below on an assumption that the estimated temperature of the photosensitive drum 1 is generally represented by T, T at the start of the image formation is represented by Ti, and T at the stop of the image formation is represented by Tk.

The table C is first described. The table C is made up of 21 tables, i.e., temperature rise tables 00-20. The temperature rise tables 00-20 are each a table representing the temperature of the photosensitive drum 1 with respect to the image formation time.

As space is limited, FIG. 8A plots only three temperature rise tables (i.e., the temperature rise tables 00, 03 and 08). Although FIG. 8A is not in the form of a table, the plotted graph is actually stored in the form of a table, i.e., as the table C.

In this exemplary embodiment, a temperature rise profile of the photosensitive drum 1 differs depending on the difference between the estimated temperature Ti of the photosensitive drum 1 and the environment temperature Tc at the start of the image formation, i.e., (Ti−Tc). Stated another way, the temperature rise profile has such a characteristic that an amount of the temperature rise of the photosensitive drum 1 is increased with respect to the image formation time as (Ti−Tc) becomes smaller.

Therefore, the table to be used differs depending on (Ti−Tc) at the start of the image formation. Referring to FIG. 8A, for example, when (Ti−Tc) is 0° C., i.e., when Ti and Tc are equal to each other, the temperature rise table 00 is used. When (Ti−Tc) is 8° C., the temperature rise table 08 is used.

Thus, the temperature of the photosensitive drum 1 can be accurately estimated by selecting optimum one of 21 tables, which constitute the table C, depending on the value of (Ti−Tc) at the start of the image formation.

While 21 temperature rise tables are prepared as the table C in this exemplary embodiment, the number of tables to be prepared is not limited to 21. The temperature rise table is just required to be prepared in number sufficient for accurately estimating the temperature of the photosensitive drum 1.

The reason why 21 tables are prepared as the table C in this exemplary embodiment is that satisfactory accuracy is obtained if the temperature of the photosensitive drum 1 can be estimated in units of 1° C., and that the temperature of the photosensitive drum 1 is raised up to 20° C. at maximum.

The table D is next described. The table D is made up of 21 tables, i.e., temperature fall tables 00-20. The temperature fall tables 00-20 are each a table representing the temperature of the photosensitive drum 1 with respect to the image formation stop time.

As space is limited, FIG. 8B plots only three temperature fall tables (i.e., the temperature fall tables 02, 09 and 14). Although FIG. 8B is not in the form of a table, the plotted graph is actually stored in the form of a table, i.e., as the table D.

In this exemplary embodiment, a temperature fall profile of the photosensitive drum 1 differs depending on the difference between the estimated temperature Tk of the photosensitive drum 1 and the environment temperature Tc at the stop of the image formation, i.e., (Tk−Tc), and it tends to saturate toward the environment temperature Tc with the lapse of the image formation stop time.

Therefore, the temperature fall profile has such a characteristic that an amount of the temperature fall of the photosensitive drum 1 is increased with respect to the image formation time as (Tk−Tc) becomes larger. Stated another way, the table to be used differs depending on (Tk−Tc) at the stop of the image formation. Referring to FIG. 8B, for example, when (Tk−Tc) is 14° C., the temperature fall table 14 is used. When (Tk−Tc) is 2° C., the temperature fall table 02 is used.

Thus, the temperature of the photosensitive drum 1 can be accurately estimated by selecting optimum one of 21 tables, which constitute the table D, depending on the value of (Tk−Tc) at the stop of the image formation.

While 21 temperature fall tables are prepared as the table D in this exemplary embodiment, the number of tables to be prepared is not limited to 21. The temperature fall table is just required to be prepared in number sufficient for accurately estimating the temperature of the photosensitive drum 1.

The reason why 21 tables are prepared as the table D in this exemplary embodiment is that satisfactory accuracy is obtained if the temperature of the photosensitive drum 1 can be estimated in units of 1° C., and that the temperature of the photosensitive drum 1 is raised up to 20° C. at maximum.

By using the table C and the table D described above, the temperature of the photosensitive drum 1 can be accurately estimated during the image formation and during the stop of the image formation. The reason why the temperature of the photosensitive drum 1 is not directly measured by the temperature and humidity sensor is that, even when the temperature and humidity sensor is disposed near the photosensitive drum 1, an error is caused between the actual temperature of the photosensitive drum 1 and the temperature measured by the temperature and humidity sensor. Such an error is presumably attributable to that the temperature rise of the photosensitive drum (member) is affected by not only the temperature near the photosensitive drum, but also sliding frictions of the photosensitive drum with respect to the charging member and the cleaning member which contact the photosensitive drum. In this exemplary embodiment, therefore, the temperature of the photosensitive drum 1 is accurately estimated based on the photosensitive drum rotation time and the photosensitive drum stop time.

Further, in this exemplary embodiment, the variation amount ΔD due to the VL-down is proportional to the difference between the estimated temperature T of the photosensitive drum 1 and the temperature Tc of the atmosphere environment, i.e., (Tk−Tc) . Herein, the temperature Tc of the atmosphere environment is the environment temperature of the image forming apparatus at the time when the reference charging voltage is determined with the Dmax control.

That relationship is represented by a table E shown in FIG. 8C.

More specifically, in this exemplary embodiment, by estimating the temperature T of the photosensitive drum 1, the variation amount ΔD due to the VL-down can be calculated and the first correction amount can be calculated so as to cancel the variation amount ΔD . In other words, the first correction amount for correcting the variation amount ΔD due to the VL-down depends on the temperature of the photosensitive drum 1 and the temperature of the atmosphere environment around the photosensitive drum 1.

For example, when (T−Tc) is 4° C., the variation amount ΔD due to the VL-down is +5 V from the table E. Therefore, the first correction amount is determined so as to cancel +5 V. In other words, in the case of ΔD being +5 V, if the charging voltage remains the same value, this means that the VL is reduced by 5 V in its absolute value. Hence the correction is performed to increase the charging value by 5 V in its absolute value. Although FIG. 8C is not in the form of a table, the plotted graph is actually stored in the form of a table, i.e., as the table E.

Thus, as seen from the table E of FIG. 8C, the VL variation amount ΔD due to the VL-down is increased as the temperature Tc of the atmosphere environment around the photosensitive drum 1 is lowered. Also, since the temperature T of the photosensitive drum 1 is raised with an increase of the image formation time t1 (table C of FIG. 8A), the VL variation amount ΔD due to the VL-down is increased with an increase of the image formation time t1. Further, since the temperature T of the photosensitive drum 1 is lowered with an increase of the image formation stop time t2 (table D of FIG. 8B), the VL variation amount ΔD due to the VL-down is reduced with an increase of the image formation stop time t2 (however, ΔD<0 never occurs).

Figure 2:
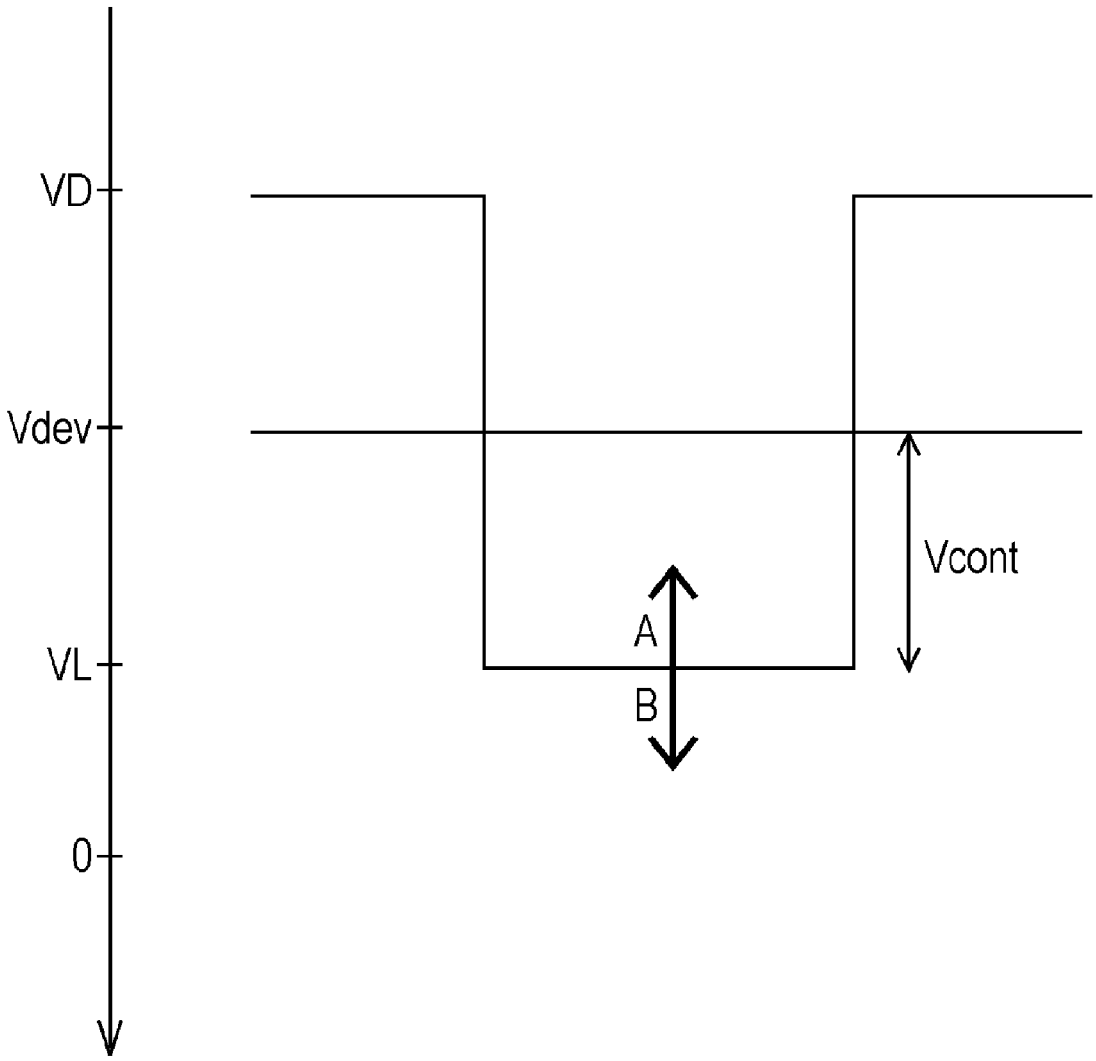
FIG. 2 illustrates the concept of a surface potential of a photosensitive member.
Figure 3A:
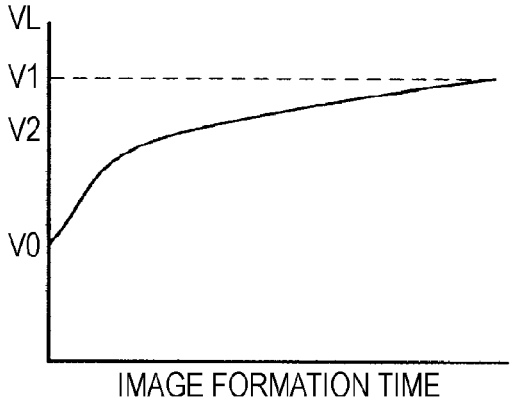
FIGS. 3A-3F are each a chart representing the relationship between an image formation time (or an image formation stop time) and a surface potential of a photosensitive drum.
Figure 3B:
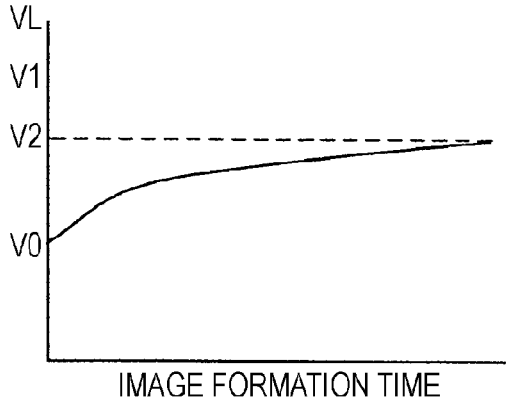
Figure 3C:
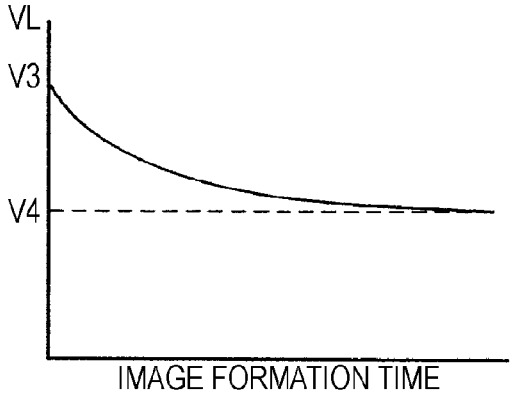
Figure 3D:
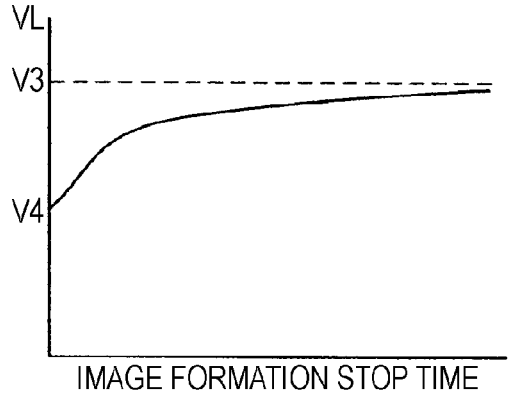
Figure 3E:
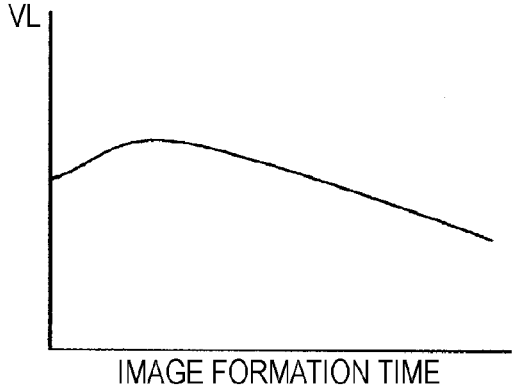
Figure 3F:
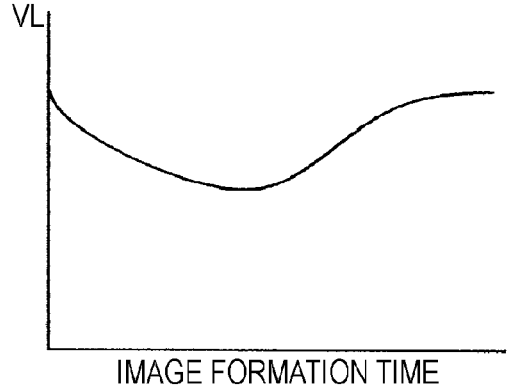

When the VL variation amount ΔD due to the VL-down is increased as shown in FIG. 2 (direction B in FIG. 2), the first correction amount for increasing the absolute value of VD so as to cancel the VL variation amount ΔD is added to the image formation condition. Also, when the VL variation amount ΔD due to the VL-down is reduced, the first correction amount for reducing the absolute value of VD correspondingly is added to the image formation condition. Herein, the value of VD has positive correlation with respect to the magnitude of a value of the charging voltage applied to the charging apparatus such that the VD value is increased as the charging voltage increases.

Stated another way, when the temperature of the photosensitive drum 1 is the same, the charging voltage is corrected to increase the absolute value of VD as the temperature Tc of the atmosphere environment around the photosensitive drum 1 is lowered. Also, the charging voltage is corrected to increase the absolute value of VD as the image formation time t1 is prolonged. Further, the charging voltage is corrected to reduce the absolute value of VD as the image formation stop time t2 is prolonged.

While this exemplary embodiment employs the VL-down table 28 as a table for calculating the variation amount ΔD due to the VL-down, the table to be referred is not limited to the illustrated one. The table C can be modified such that the temperature of the photosensitive drum 1 with respect to the image formation time is replaced with another value. The table D can be modified such that the temperature of the photosensitive drum 1 with respect to the image formation stop time is replaced with another value. The table E can be modified using another value so long as the value can represent the relationship between the temperature of the photosensitive drum 1 and the VL-down.

Instead of storing the table C, the table D, and the table E in the form of a table, those tables can also be stored in the form of a formula so long as the formula can express the characteristics of the temperature of the photosensitive drum 1 and the VL-down.

Further, in this exemplary embodiment, the estimated temperature of the photosensitive drum 1 is determined from the environment temperature, the image formation time, and the image formation stop time. However, if the temperature of the photosensitive drum 1 can be directly measured with high accuracy, the image formation conditions can be changed depending on the temperature of the photosensitive drum 1 and the environment temperature.

(Method of Calculating Correction Amount (Second Correction Amount) for VL Variation due to VL-Up)

Next, a description is made of the method of calculating the correction amount (second correction amount) for the VL variation due to the VL-up. The VL variation amount ΔU due to the VL-up is calculated by referring to a VL-up table 27, shown in FIG. 1, which is stored in the storage unit 20.

Figures 7A, 7B:
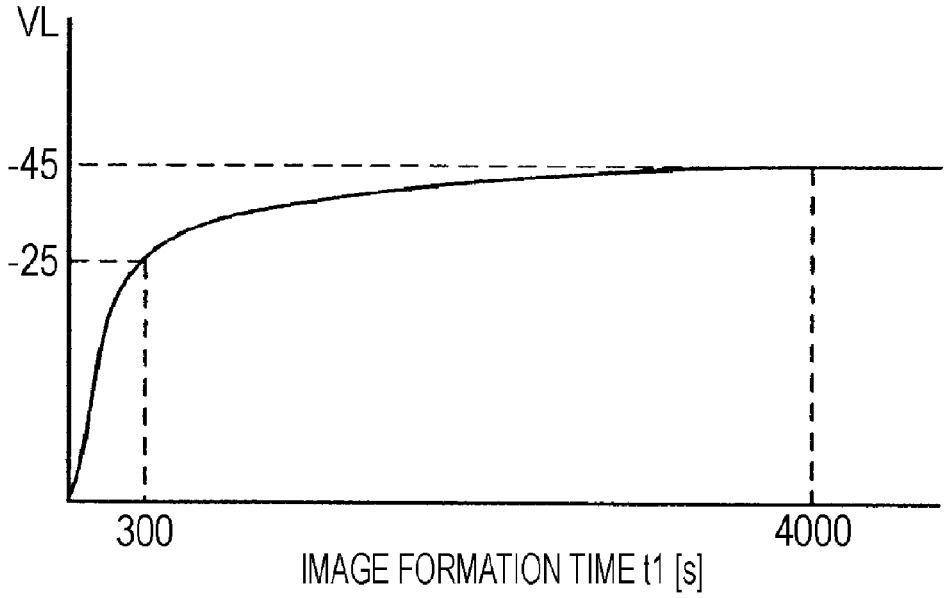
FIGS. 7A and 7B illustrate details of a VL-up table in the exemplary embodiment.

As shown in FIGS. 7A and 7B, the VL-up table 27 is made up of a table A and a table B. The VL variation amount ΔU due to the VL-up with respect to the image formation time is calculated based on those tables.

As shown in FIG. 7A, the table A represents the variation amount of VL with respect to the image formation time. As shown in FIG. 7B, the table B is in the form of (3×3) matrix including coefficients each of which is selected depending on the conditions (absolute humidity and image formation stop time) at the start of the image formation.

The variation amount due to the VL-up with respect to the image formation time is calculated by multiplying a value in the table A by the coefficient selected from the table B. Although FIG. 7A is not in the form of a table, the plotted graph is actually stored in the form of a table, i.e., as the table A.

The reason why a value in the table A is multiplied by the coefficient selected from the table B is that the variation amount of VL depends on the absolute humidity and the image formation stop time. In this exemplary embodiment, as the absolute humidity rises, the amount of the VL-up is reduced. In the environment with the absolute humidity $W \geqq 2.5$ g/m$^3$, the VL-up does not occur at all.

Further, in this exemplary embodiment, as the image formation stop time from the end of the preceding image formation to the start of the next image formation becomes shorter, the VL variation amount ΔU during the image formation is reduced.

The table B includes, as described above, the coefficients reflecting the influence of the absolute humidity and the influence of the image formation stop time. In other words, the variation amount due to the VL-up can be accurately calculated in any conditions by multiplying a value in the table A by the coefficient selected from the table B.

The second correction amount is calculated so as to cancel the VL variation amount ΔU due to the VL-up.

More specifically, as seen from the table B, the VL variation amount ΔU due to the VL-up is increased as the absolute humidity W of the atmosphere environment is lowered. Also, the VL variation amount ΔU due to the VL-up is increased with an increase of the image formation stop time t2. Further, as seen from the table A, the VL variation amount ΔU due to the VL-up is increased with an increase of the image formation time t1. When the VL variation amount ΔU due to the VL-up is increased as shown in FIG. 2 (direction A in FIG. 2), Vcont is reduced.

Thus, the second correction amount is set so as to cancel the increase of the VL variation amount ΔD due to the VL-up. Stated another way, when ΔU is increased, the correction is performed such that the absolute value of the charging voltage is reduced to decrease the absolute value of VD. With that correction, Vcont can be restored to the original value (see FIG. 2).

More specifically, the absolute value of the charging voltage is reduced as the absolute humidity W of the atmosphere environment around the photosensitive drum 1 is lowered. Also, the absolute value of the charging voltage is reduced as the image formation time t1 is prolonged. Further, the absolute value of the charging voltage is reduced as the image formation stop time t2 is prolonged.

While this exemplary embodiment employs the VL-up table 27 as a table for calculating the VL variation amount ΔU due to the VL-up, the table to be referred is not limited to the illustrated one. The table A can be modified such that the VL variation amount ΔU due to the VL-up with respect to the image formation time is replaced with another value.

Similarly, the table B can be modified such that the values in the table are replaced with other values, or that, instead of (3×3) matrix, a matrix having a different size is used. Further, instead of storing the table A and the table B in the form of a table, those tables can also be stored in the form of a formula so long as the formula can express the characteristics of the VL-up.

With the above-described methods, the calculation unit 25 can calculate the first and second correction amounts by calculating the variation amount due to the VL-up based on the VL-up table 27 and by calculating the variation amount due to the VL-down based on the VL-down table 28. Further, the charging voltage VD is controlled in accordance with the calculated first and second correction amounts. The first correction amount is calculated depending on the temperature, the image formation time (rotation time of the photosensitive drum 1), the image formation stop time (rotation stop time of the photosensitive drum 1). The second correction amount is calculated depending on the absolute humidity, the image formation time (rotation time of the photosensitive drum 1), the image formation stop time (rotation stop time of the photosensitive drum 1). When controlling the image formation conditions by using the first correction amount and the second correction amount, therefore, in a range where the absolute humidity is low (i.e., in a first range), the image formation conditions are controlled depending on the temperature, the absolute humidity, the image formation time (rotation time of the photosensitive drum 1), and the image formation stop time (rotation stop time of the photosensitive drum 1).

As described above, in a range where the absolute humidity is high (i.e., in a second range where $W \geqq 2.5$ g/m$^3$ is satisfied in this exemplary embodiment), the VL-up does not occur at all. Hence there is no need of calculating the second correction amount. Accordingly, in the range where the absolute humidity is high, the image formation conditions are controlled depending on the temperature, the image formation time (rotation time of the photosensitive drum 1), and the image formation stop time (rotation stop time of the photosensitive drum 1).

Further, since a phenomenon of the VL-up does not occur in the range where the absolute humidity is high, the absolute value of the charging voltage or the development voltage is smaller at a high absolute humidity than a low absolute humidity if other conditions (i.e., the temperature, the image formation time, and the image formation stop time) than the absolute humidity are the same.

Based on the information of the calculated result, the control unit 23 sends, to the image forming unit, information for controlling the charging voltage in the developing apparatus 5. In this exemplary embodiment, the charging voltage VD is controlled so that the development contrast (Vcont) is held constant.

(Concrete Flow of Image Formation Condition Control)

Figure 9:
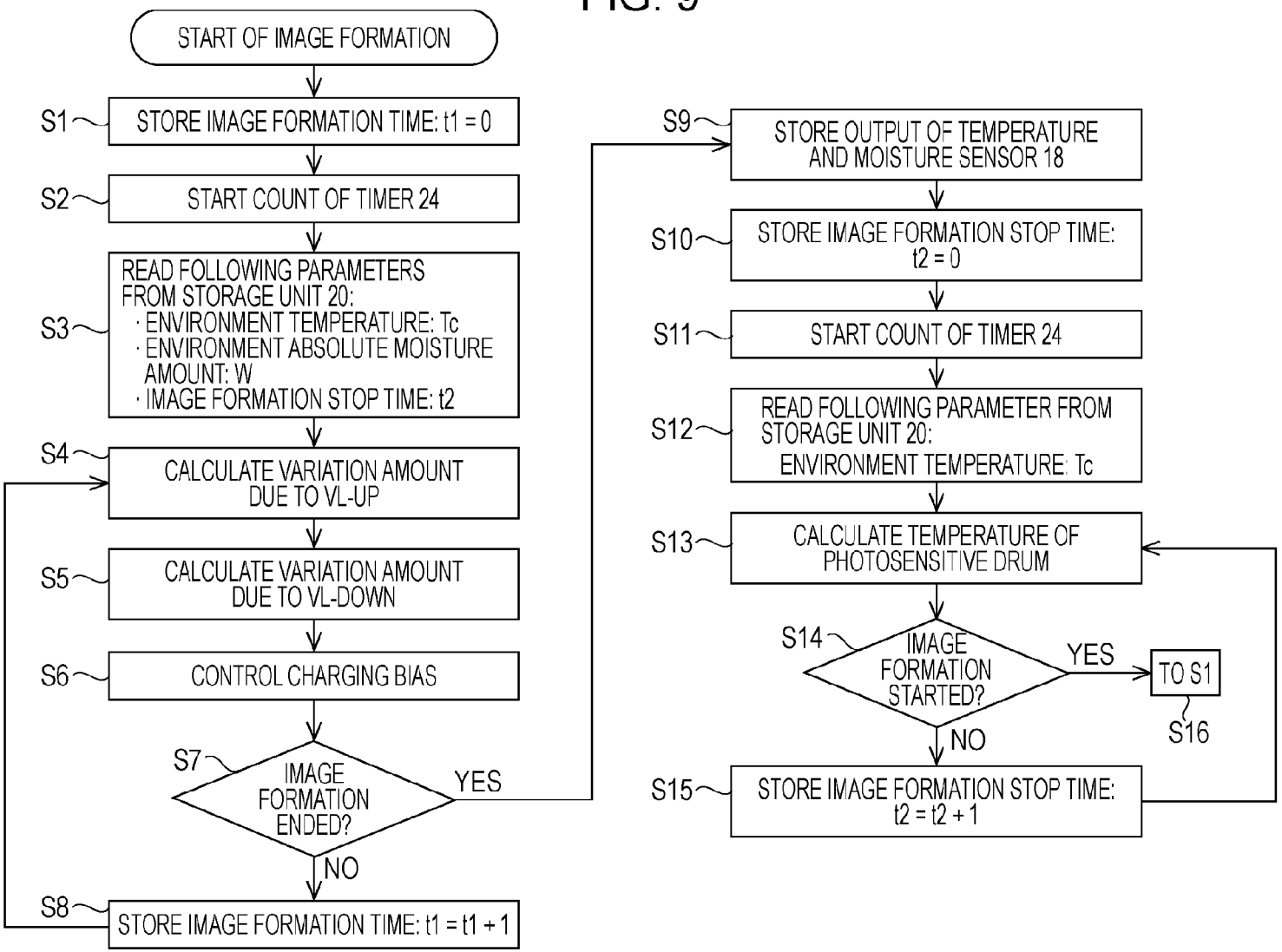
FIG. 9 is a flowchart illustrating the image formation condition control in the exemplary embodiment.

A flow of the image formation condition control in this exemplary embodiment will be described below with reference to a flowchart of FIG. 9.

When the start of the image formation is instructed, the image formation time t1 is stored as 0 in the storage unit 20 (S1), and the timer 24 starts to count time in units of one second (S2). Then, the read unit 21 reads the environment temperature, the absolute humidity, and the image formation stop time from the storage unit 20 (S3).

The calculation unit 25 calculates, by the above-described method, the variation amount ΔU due to the VL-up based on the image formation time, the image formation stop time, and the absolute humidity (S4).

Further, the calculation unit 25 calculates, by the above-described method, the variation amount ΔD due to the VL-down based on the image formation time, the image formation stop time, and the environment temperature (S5).

Based on the variation amount ΔU due to the VL-up and the variation amount ΔD due to the VL-down which have been calculated in S4 and S5, respectively, the calculation unit 25 calculates the VL variation amount (ΔU+ΔD). In accordance with the calculated result, the control unit 23 controls the charging voltage applied to the charging apparatus 2 so that Vcont is held constant (S6).

The CPU 22 determines whether the image formation is to be ended. If the image formation is continued (No in S7), the count of the image formation time t1 is incremented by 1 second (S8). The steps S4-S7 are repeated until the image formation is ended. If the image formation is ended (Yes in S7), the processing is transited to the calculation during the stop of the image formation.

At the end of the image formation, the CPU 22 stores, in the storage unit 20, the environment temperature and the absolute humidity which are input from the temperature and humidity sensor 18 (S9).

Further, the image formation stop time t2 is stored as 0 in the storage unit 20 (S10), and the timer 24 starts to count time in units of one second (S11) . Then, the read unit 21 reads the environment temperature from the storage unit 20 (S12).

The calculation unit 25 calculates, by the above-described method, the temperature of the photosensitive drum 1 at the stop of the image formation (S13).

The CPU 22 determines whether the image formation is to be started. If the image formation remains stopped (No in S14), the count of the image formation stop time t2 is incremented by 1 second (S15). The steps S13-S14 are repeated until the image formation is started, and the CPU 22 continues the calculation of the temperature of the photosensitive drum 1 during the stop of the image formation. If the image formation is started (Yes in S14), the processing is returned to S1, i.e., transited to the calculation during the image formation (S16).

While this exemplary embodiment is constituted to control the charging voltage as the image formation condition control, the control can also be performed by correcting the development voltage Vdev. In the case of controlling the development voltage Vdev, when the VL-up occurs, the absolute value of the development voltage is increased so as to hold Vcont constant. Also, when the VL-down occurs, the absolute value of the development voltage is reduced so as to hold Vcont constant. Further, the charging voltage and the development voltage Vdev can be both controlled.

The advantages obtained with this exemplary embodiment will be described below by comparing the case where the image formation condition control in this exemplary embodiment is performed with the case where that control is not performed (Comparative Example) . Herein, it is assumed to employ the method of controlling the development voltage Vdev. It is also assumed that an image forming apparatus of Comparative Example has the same construction as the image forming apparatus 100 of this exemplary embodiment except for not executing the above-described image formation condition control in the former.

Figure 10A:
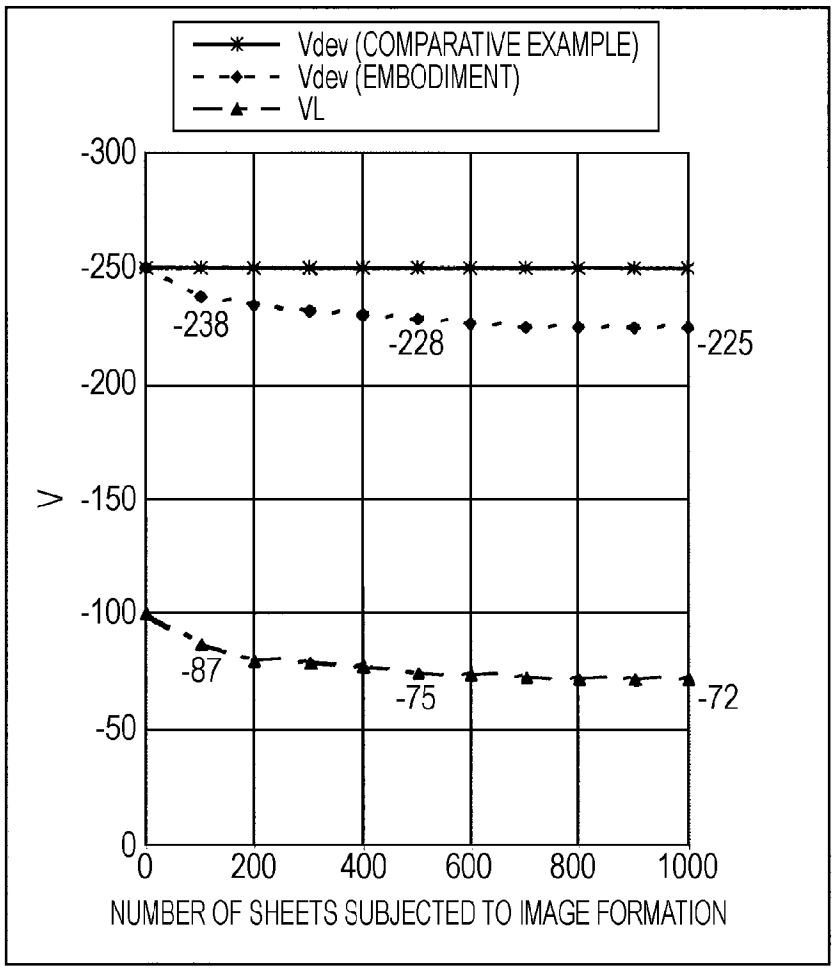
FIGS. 10A and 10B are graphs plotting respectively the surface potential of the photosensitive drum with respect to the number of sheets subjected to the image formation and the image density with respect to the number of sheets subjected to the image formation in an N/N environment.

FIG. 10A plots changes of the development voltage (Vdev) and the VL in Comparative Example and this exemplary embodiment when the Dmax control and the Dhalf control were executed and the image formation was continuously performed until printing 1000 sheets in the N/N environment (23° C./15% RH and absolute humidity of 8.87 g/m$^3$) . The image formation stop time (t2) prior to the start of the image formation was 5000 seconds.

Figure 10B:
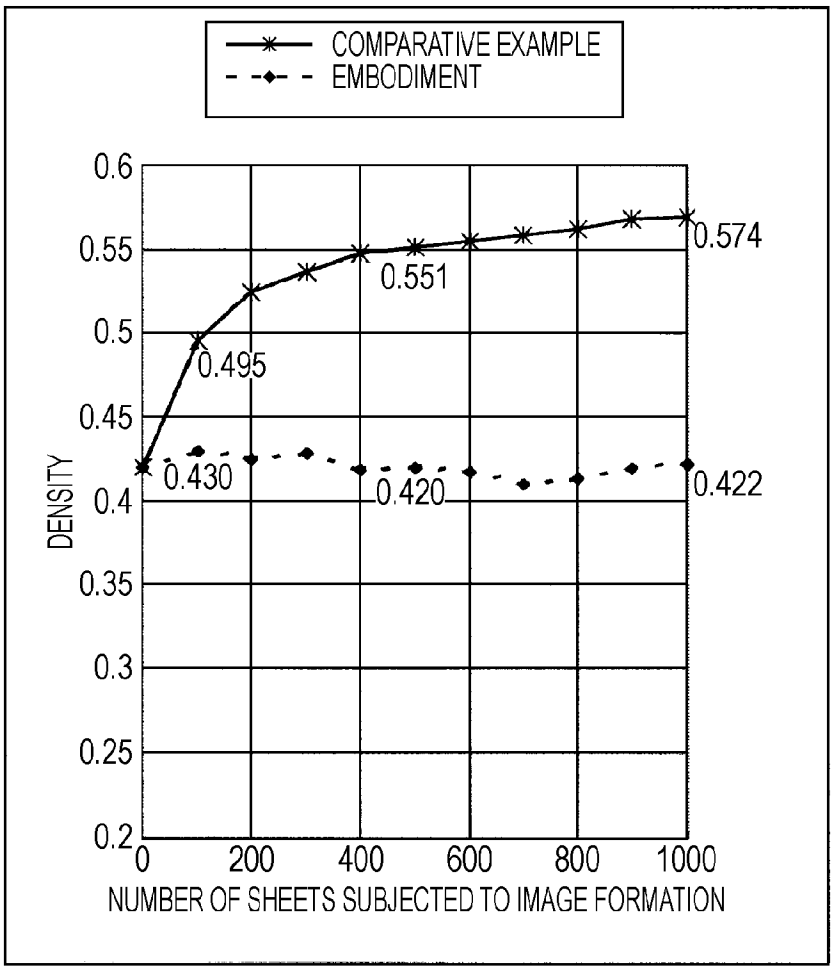

FIG. 10B plots changes of half-tone density under the same conditions as those described above. Regarding FIG. 10B, chromaticity of a print was measured by a method of forming toner patches in 10 gradations per color on a transfer material (product name: Color Laser Copier Paper 81.4 g/m$^2$ made by CANON KABUSHKI KAISHA). More specifically, the color of each of the formed toner patches was measured by using GRETAGSpectrolino (made by Gretag Macbeth). FIG. 10B plots, as one example of the measured result, density changes of the halftone (printing rate: 50%) patch of magenta.

As seen from FIG. 10A, with the image forming apparatus 100 of this exemplary embodiment, the VL is reduced by 28 V after passing of 1000 sheets in the N/N environment. Such a characteristic is presumably attributable to that, since the variation due to the VL-up does not occur at all and only the variation due to the VL-down occurs in the N/N environment, the VL continues to reduce with an increase of the number of sheets subjected to the image formation and it is eventually saturated.

In Comparative Example, because the printing is always performed at the development voltage (−250 V) determined by the Dmax control, Vcont is increased with an increase of the number of sheets subjected to the image formation and an increase amount of Vcont is 28 V after passing of 1000 sheets. Accordingly, in Comparative Example, the image density is increased with an increase of the number of sheets subjected to the image formation and an increase amount of the image density is 0.154 after passing of 1000 sheets, as shown in FIG. 10B.

On the other hand, when the image formation condition control of this exemplary embodiment is executed, the printing is performed while calculating the VL variation and gradually changing the development voltage from its value (−250 V) which has been determined with the Dmax control. Accordingly, Vcont can be held constant regardless of the number of sheets subjected to the image formation.

As seen from FIG. 10A, therefore, the variation of Vcont is suppressed to 3 V after passing of 1000 sheets. As a result, the image density is stabilized regardless of the number of sheets subjected to the image formation in this exemplary embodiment. More specifically, it is confirmed, as shown in FIG. 10B, that the image density is in the range of 0.410-0.430 and the density variation is 0.020, whereby a stable image density is obtained.

While FIG. 10B plots only the result of measuring the halftone (printing rate of 50%) patch of magenta, it is confirmed that this exemplary embodiment can also stabilize the density of the magenta patches with other gradations and the density of patches in other colors. Further, it is confirmed that the image density is stabilized by using this exemplary embodiment not only in continuous printing, but also in intermittent printing.

Figure 11A:
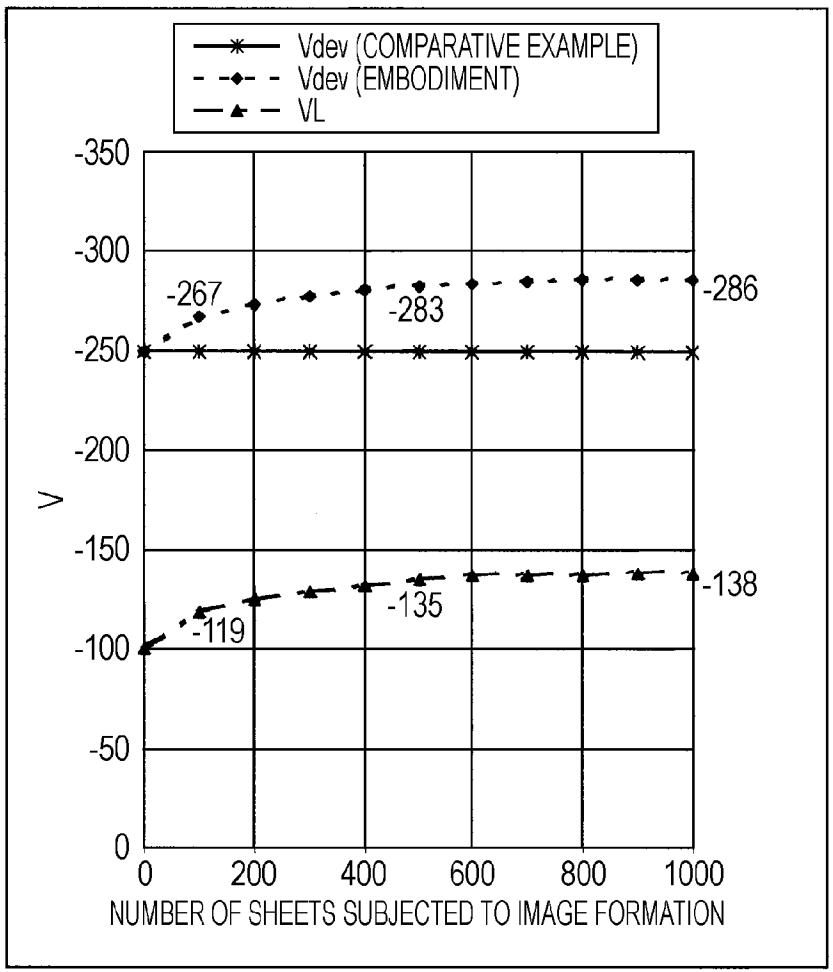
FIGS. 11A and 11B are graphs plotting respectively the surface potential of the photosensitive drum with respect to the number of sheets subjected to the image formation and the image density with respect to the number of sheets subjected to the image formation in an L/L environment.

FIG. 11A plots changes of the development voltage (Vdev) and the VL in Comparative Example and this exemplary embodiment when the Dmax control and the Dhalf control were executed and the image formation was continuously performed until printing 1000 sheets in the L/L environment (15° C./10% RH and absolute humidity of 1.06 g/m$^3$).

Figure 11B:
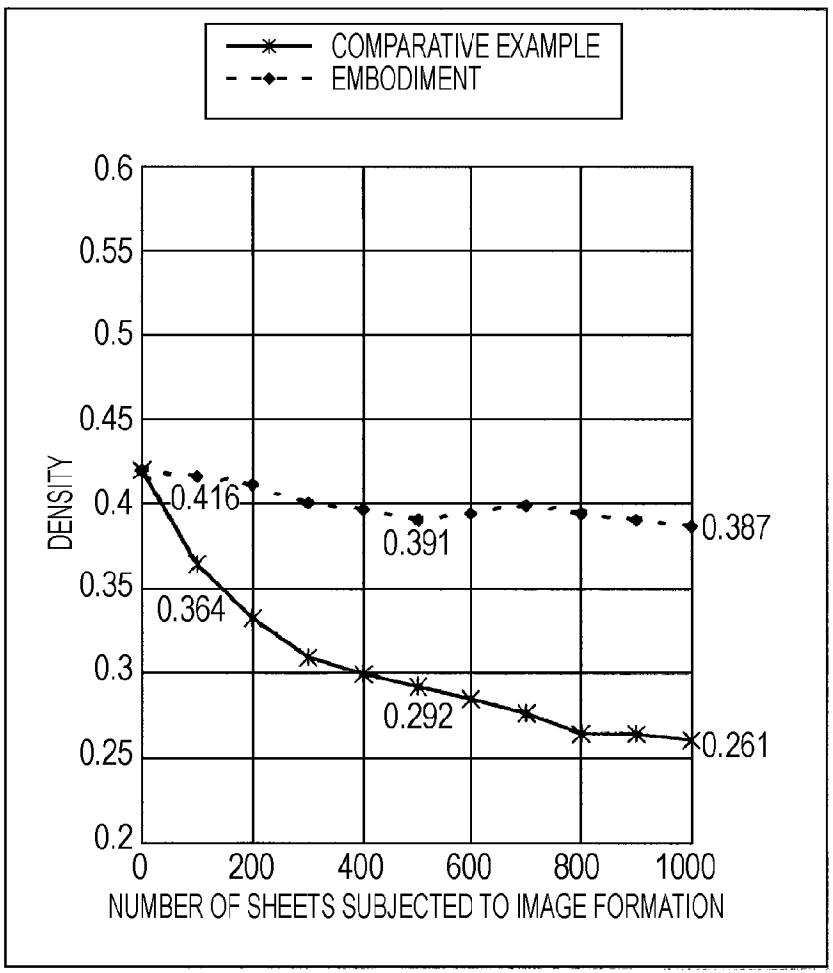

FIG. 11B plots changes of half-tone density under the same conditions as those described above. Chromaticity of a print was measured by the same method as that used in the case of the N/N environment shown in FIG. 10B. FIG. 11B plots, as one example of the measured result, density changes of the halftone (printing rate: 50%) patch of magenta.

As seen from FIG. 11A, with the image forming apparatus 100 of this exemplary embodiment, the VL is increased by 38 V after passing of 1000 sheets in the L/L environment. Such a characteristic is presumably attributable to that, although the VL-down should also occur due to the temperature rise of the photosensitive drum 1 in the L/L environment, the variation amount due to the VL-up is very large because of low absolute humidity, and therefore the VL continues to increase with an increase of the number of sheets subjected to the image formation and is eventually saturated.

In Comparative Example, because the printing is always performed at the development voltage (−250 V) determined by the Dmax control, Vcont is decreased with an increase of the number of sheets subjected to the image formation and a decrease amount of Vcont is 38 V after passing of 1000 sheets.

Accordingly, in Comparative Example, the image density is decreased with an increase of the number of sheets subjected to the image formation and a decrease amount of the image density is 0.159 after passing of 1000 sheets, as shown in FIG. 11B.

On the other hand, when the image formation condition control of this exemplary embodiment is executed, the printing is performed while calculating the VL variation and gradually changing the development voltage from its value (−250 V) which has been determined with the Dmax control. Accordingly, Vcont can be held constant regardless of the number of sheets subjected to the image formation.

As seen from FIG. 11A, therefore, the variation of Vcont is suppressed to 2 V after passing of 1000 sheets. As a result, the image density is stabilized regardless of the number of sheets subjected to the image formation in this exemplary embodiment. More specifically, it is confirmed, as shown in FIG. 11B, that the image density is in the range of 0.387-0.420 and the density variation is 0.033, whereby a stable image density is obtained.

While FIG. 11B plots only the result of measuring the halftone (printing rate of 50%) patch of magenta, it is confirmed that this exemplary embodiment can also stabilize the density of the magenta patches with other gradations and the density of patches in other colors. Further, it is confirmed that the image density is stabilized by using this exemplary embodiment not only in continuous printing, but also in intermittent printing.

Thus, according to this exemplary embodiment, even in any of the continuous and intermittent printing, an image can be always produced at a stabilized density and a high-quality image can be always obtained by determining the VL variation of the photosensitive drum 1 and adding the correction amount based on the determined result.

Also, since characteristics of the VL variation depending on the atmosphere environment (temperature and absolute humidity) can be accurately estimated, an image can be always produced at a density stabilized depending on variations of the atmosphere environment.

In this exemplary embodiment, the characteristics of the photosensitive drum 1 have no differences among the stations of Y, M, C and K, the charging voltage control is executed in the same manner in all the stations. However, the control method for the charging voltage can also be changed among the stations.

Also, while the charging voltage is controlled in this exemplary embodiment based on the result of estimating the variation of VL as the surface potential of the photosensitive drum 1, the charging voltage can also be controlled based on the result of estimating a potential variation in a halftone image area.

Further, while the charging voltage is controlled in units of one second in this exemplary embodiment, the charging voltage can also be controlled in suitable one of different units. For example, the charging voltage can be controlled in units of 0.5 second or one page.

In addition, while this exemplary embodiment controls the charging voltage as the image formation condition to hold Vcont constant, the system configuration can be modified so as to control the development voltage Vdev.

In other words, the control can also be executed so as to hold Vcont constant by determining the VL variation and adding correction amounts (third and fourth correction amounts) to the development voltage Vdev while keeping the charging voltage VD constant.

More specifically, in such a modification, the image formation condition control is executed through the steps of determining the VL variations due to the VL-down and the VL-up, and adding correction amounts (VL-down correction amount: third correction amount and VL-up correction amount: fourth correction amounts), which cancel the determined VL variations, to the development voltage.

To that end, a table representing the relationship between the development voltage and the predicted VL is stored in the storage unit 20, and the charging voltage is controlled so that the VL is always held constant.

Since a method of calculating the third correction amount is the same as the above-described method of calculating the first correction amount, the method of calculating the third correction amount is omitted here by prompting reference to the above-described method of calculating the first correction amount.

Since a method of calculating the fourth correction amount is the same as the above-described method of calculating the second correction amount, the method of calculating the fourth correction amount is omitted here by prompting reference to the above-described method of calculating the second correction amount.

Further, the charging voltage and the development voltage Vdev can be both controlled in accordance with the predicted result of the VL variation.

Still further, the VL variation can be corrected by changing the exposure amount in accordance with the predicted result of the VL variation.

As described above, the image forming apparatus can be provided which can properly execute the image formation condition control and can always produce an image at a stable density by correcting the VL variation based on the temperature of the atmosphere environment around the photosensitive drum 1, the absolute humidity, the image formation time, and the image formation stop time.

Second Exemplary Embodiment

A second exemplary embodiment is featured in stopping the control of changing the image formation conditions when the temperature and humidity environment in which the image forming apparatus is installed is greatly changed. Since the other points are the same as those in the first exemplary embodiment, only the feature specific to the second exemplary embodiment is described below.

In the first exemplary embodiment, the environment temperature Tc and the absolute humidity W are measured during the period from power-on of the image forming apparatus until coming into the standby state ready for starting the image formation, and the measured results are stored in the storage unit. The correction amounts are calculated depending on the measured temperature and absolute humidity. However, if the environment in which the image forming apparatus is installed is abruptly changed during the interval from the preceding measurement of the temperature and the absolute humidity to the next measurement of the temperature and the absolute humidity, there is a possibility that the calculated result of the correction amount is not fit for the current environment.

In an image forming apparatus of the second exemplary embodiment, when values of the environment temperature and the absolute humidity measured by the temperature and humidity sensor 18 are greatly changed, the control of correcting the image formation conditions depending on the VL variation is stopped.

With that feature, the image formation conditions can be prevented from becoming unsuitable due to abrupt changes of the temperature and humidity environments.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-145479 filed May 31, 2007, and Japanese Application No. 2008-095957 filed Apr. 2, 2008, which are hereby incorporated by reference herein in their entirety.

What is claimed is:

1. An image forming apparatus including:

a rotatable photosensitive member;

a charging apparatus configured to charge a surface of the photosensitive member when applied with a charging voltage;

an exposure apparatus configured to expose the surface of the photosensitive member after being charged, so as to form an electrostatic image;

a developing apparatus configured to attach a developer to the electrostatic image and to develop the electrostatic image as a developer image when applied with a development voltage;

a time information obtaining apparatus configured to obtain information regarding a photosensitive member rotation time that represents a time during which the photosensitive member is rotated, and information regarding a photosensitive member stop time that represents a time during which the photosensitive member is stopped;

an environment measuring apparatus configured to measure information regarding temperature and information regarding absolute humidity; and a control apparatus configured to control an image formation condition based on the information regarding the temperature and the information regarding the absolute humidity which are measured by the environment measuring apparatus, and the information regarding the photosensitive member rotation time and the information regarding the photosensitive member stop time which are obtained by the time information obtaining apparatus when the absolute humidity is within a first range, wherein the control apparatus is configured to control the image formation condition based on the information regarding the temperature measured by the environment measuring apparatus, and the information regarding the photosensitive member rotation time and the information regarding the photosensitive member stop time which are obtained by the time information obtaining apparatus, without using the information regarding the absolute humidity measured by the environment measuring apparatus, when the absolute humidity is within a second range, wherein the second range corresponds to a higher humidity range than the first range.

2. The image forming apparatus according to claim 1, wherein the information regarding the temperature measured by the environment measuring apparatus represents a temperature during a period from power-on of the image forming apparatus until the image forming apparatus comes into a standby state.

3. The image forming apparatus according to claim 1, wherein the information regarding the humidity measured by the environment measuring apparatus represents an absolute humidity during a period from power-on of the image forming apparatus until the image forming apparatus comes into a standby state.

4. The image forming apparatus according to claim 1, wherein the information regarding the photosensitive member rotation time obtained by the time information obtaining apparatus represents a photosensitive member rotation time from start of image formation until the control apparatus executes the control of the image formation condition.

5. The image forming apparatus according to claim 1, wherein the information regarding the photosensitive member stop time obtained by the time information obtaining apparatus represents a photosensitive member stop time from end of preceding image formation to start of next image formation.

6. The image forming apparatus according to claim 1, wherein the image formation condition is at least one of the charging voltage and the development voltage.

7. The image forming apparatus according to claim 6, wherein the control apparatus controls an absolute value of the charging voltage or an absolute value of the development voltage to be smaller when the absolute humidity is within the second range than when the absolute humidity is within the first range.

* * * * *